US006120325A

United States Patent [19]

Abe

[11] Patent Number: 6,120,325

[45] Date of Patent: Sep. 19, 2000

[54] DEVICE FOR MOUNTING A SHIELDED CONNECTOR ON A CIRCUIT BOARD

[75] Inventor: Shintaro Abe, Chiba, Japan

[73] Assignee: The Whitaker Corporation, Wilmington, Del.

[21] Appl. No.: 09/233,515

[22] Filed: Jan. 20, 1999

[30] Foreign Application Priority Data

Jan. 23, 1998 [JP] Japan ..... 10-026387

[51] Int. Cl.[7] ..... H01R 13/648

[52] U.S. Cl. ..... 439/607; 439/108; 439/82; 439/573

[58] Field of Search ..... 439/607, 108, 439/573, 82

[56] References Cited

U.S. PATENT DOCUMENTS

| | | | |
|---|---|---|---|
| Re. 32,502 | 9/1987 | Kumar | 439/607 |
| 4,521,062 | 6/1985 | Kurbikoff et al. | 439/607 |
| 4,889,502 | 12/1989 | Athouse et al. | 439/607 |
| 5,228,873 | 7/1993 | Hirai | 439/573 |
| 5,249,983 | 10/1993 | Hirai | 439/573 |
| 5,423,696 | 6/1995 | Sato | 439/607 |
| 5,718,605 | 2/1998 | Morikawa et al. | 439/607 |
| 5,727,970 | 3/1998 | Koguchi et al. | 439/607 |
| 5,921,811 | 7/1999 | Hsu | 439/607 |

*Primary Examiner*—Paula Bradley
*Assistant Examiner*—Tho D. Ta

[57] ABSTRACT

A shielded electrical connector provides a highly-reliable grounding connection of shell members comprising a metal shield to a ground circuit of a circuit board in which a grounding connection is accomplished by mounting screws. The shielded electrical connector (1) comprises an insulating housing (10), upper and lower shell members (21, 22) form a metal shield and they are arranged on a top and a bottom of the housing (10), and mounting screws (30) are provided to secure the connector (1) on a circuit board (40). The upper shell member (21) has spring-loaded contact members (23) as integral parts of the upper shell member that form spring-loaded electrical connection with threaded portions (31) of the mounting screws (30). Heads (32) of the mounting screws (30) form electrical connection with a ground circuit of the circuit board (40), thus grounding the upper shell member (21) to the circuit board (40) through the mounting screws (30).

4 Claims, 3 Drawing Sheets

DEVICE FOR MOUNTING A SHIELDED CONNECTOR ON A CIRCUIT BOARD

FIELD OF THE INVENTION

This invention relates to shielded electrical connectors having a metal shield that is to be electrically connected to a ground circuit of a circuit board.

BACKGROUND OF THE INVENTION

Conventional shielded electrical connectors are shown in FIGS. 4, 5A and 5B as disclosed in Patent Publication No. 90-108277.

Shielded connector 100 shown in FIG. 4 comprises an insulating housing 101 having an L-shaped cross-sectional profile which includes a connecting section 101*a* and mounting section 101*b*, multiple electrical contacts 102 are secured in the connecting section 101*a* and a metal shield 103 shields contacts 102 and is secured on the connecting section 101*a* of the housing 101. The metal shield 103 is connected to the connecting section 101*a* of the housing 101 by screws 104 that are secured in the ground plate 105 having an L-shaped configuration, the metal shield and the ground plate are located at opposite sides of the connecting section 101*a*. On the other hand, the ground plate 105 presses the mounting section 101*b* of the housing 101 down thereby securing the housing on the circuit board 108 by means of mounting screws 106 and nuts 107. The mounting screws 106 and nuts 107 also effect an electrical connection between the ground plate 105 and a ground circuit 109 on the circuit board 108. As a result, the metal shield 103 is electrically connected to the ground circuit 109 of the circuit board 108 by means of screws 104, the ground plate 105, mounting screws 106 and nuts 107. The metal shield 103 is grounded by means of mounting screws 106 that perform functions as mounting and grounding of the connector, thereby providing for a relatively simple construction.

The shielded connector 200 shown in FIGS. 5A and 5B is an improved modification of the connector 100 depicted in FIG. 4. Metal shield 203 of shielded connector 200 has connecting tabs 203*a* at each end and each ground contact 205 has a bifurcated contact section 205*a* for the insertion of the connecting tabs 203*a* thereon. The connecting tabs 203*a* and the bifurcated contact sections 205*a* are joined together in the opening 201*c* provided in the housing 201. The ground contact 205 and the housing 201 are secured on a circuit board by means of mounting screws 106 and nuts 107 similar to the arrangement shown in FIG. 4, thus forming an electrical connection of the metal shield 203 through the connecting tabs 203*a*, the ground contact 205, the mounting screws 106 and nuts 107 to a ground circuit of the circuit board.

However, in order to connect the metal shield 103 of the shielded connector 100 shown in FIG. 4 to the ground circuit 109 of the circuit board 108, in addition to the mounting screws 106, it is necessary to use screws 104, the ground plate 105 and nuts 107. Therefore, the grounding of the metal shield requires a large number of parts; and, since the connection has a number of intermediate points, the reliability of the ground connection of the metal shield 103 is low.

On the other hand, the shielded connector 200 shown in FIGS. 5A and 5B has an advantage compared to the shielded connector 100 shown in FIG. 4 whereon the metal shield 203 has connecting tabs 203*a* and the ground contact 205 has bifurcated contact sections 205*a* that are joined in the opening 201*c* provided in the housing 201, thus making it possible to eliminate the screws 104 for the connection of the metal shield 203 to the ground circuit. Nevertheless, in order to implement the grounding of the metal shield 203 to the circuit board of shielded connector 200, it is still necessary to use a large number of parts, including the mounting screws 106, the ground contact 205 and the nuts 107 without improving the reliability of the ground connection of the shell 203.

Another problem associated with the shielded connectors 100 and 200 shown in FIGS. 4, 5A and 5B consists in the fact that the ground connection of the metal shields 103, 203 requires the installation of the ground plate 105 and the ground contact 205 and the mounting screws 106, 106 on both sides of the metal shields 103, 203, which entails a complicated assembly process.

SUMMARY OF THE INVENTION

Accordingly, an object of the present invention is to provide a shielded electrical connector that has an improved reliability of a ground connection of shield members to a circuit board that can be implemented by means of mounting screws.

Another object of the present invention is to provide a shielded electrical connector wherein the simplicity of the operations required for the implementation of the ground connection of the shield members to the circuit board is by means of mounting screws.

The shielded electrical connector of the present invention comprises an insulating housing, a metal shield including two shell members attached to the housing from a top and a bottom thereof, and of mounting screws for mounting of the connector to a circuit board. Integral spring-loaded contact members are provided in an upper shell member of the metal shield that are in direct electrical connection with threaded portions of the mounting screws, and heads of the mounting screws are in electrical connection with a ground circuit of the circuit board.

A more efficient method to secure the connector on the circuit board is attained by passing the mounting screws from underneath the board and screwing them in mounting nuts with the electrical connection being achieved by the spring-loaded contact members engaging the threaded portions of the screws.

BRIEF DESCRIPTION OF THE DRAWINGS

An embodiment of the present invention will now be described by way of example with reference to the accompanying drawings in which:

FIG. 5A is a part perspective view of the connector, and FIG. 5B is a part cross-sectional view showing a metal shield and ground plate during their joining.

DETAILED DESCRIPTION OF THE INVENTION

Figure 1:
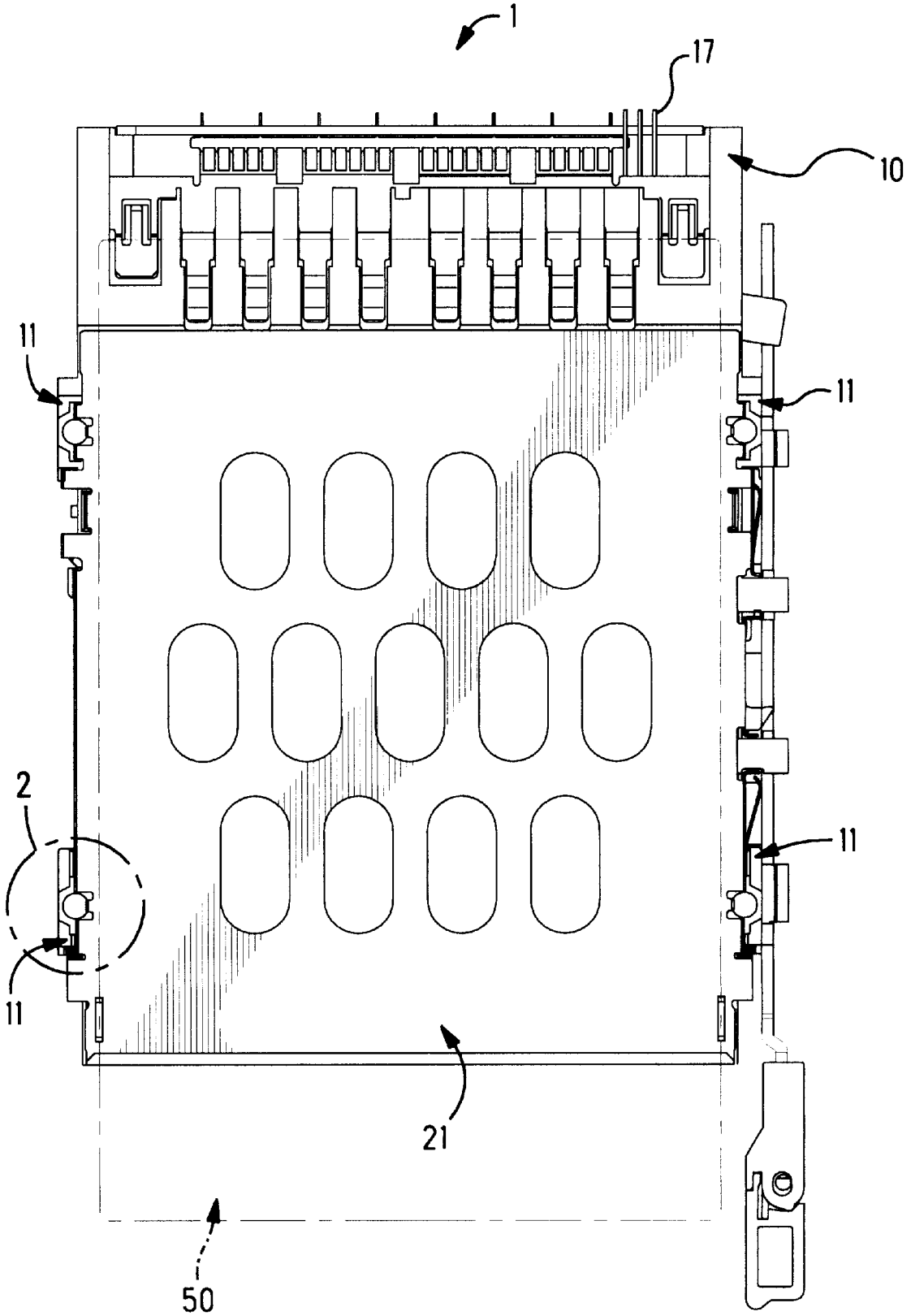
FIG. 1 is a top plan view of a shielded electrical connector according to this invention.
Figure 2:
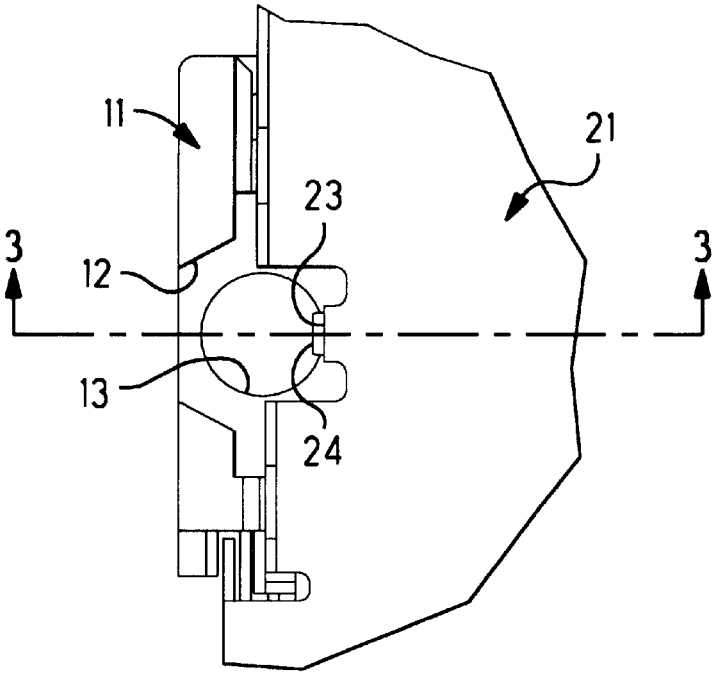
FIG. 2 is an enlarged view of a portion encircled by broken line 2 in FIG. 1.
Figure 3:
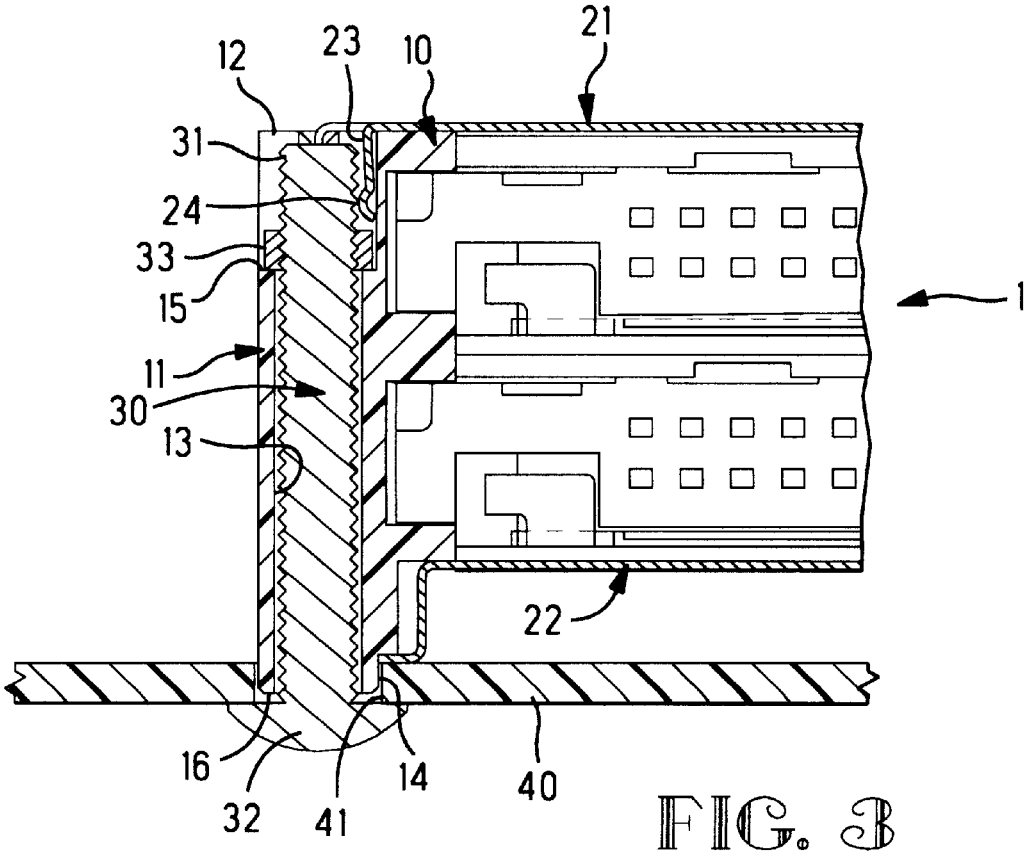
FIG. 3 is a part cross-sectional view taken along line 3—3 in FIG. 2.
Figure 4:
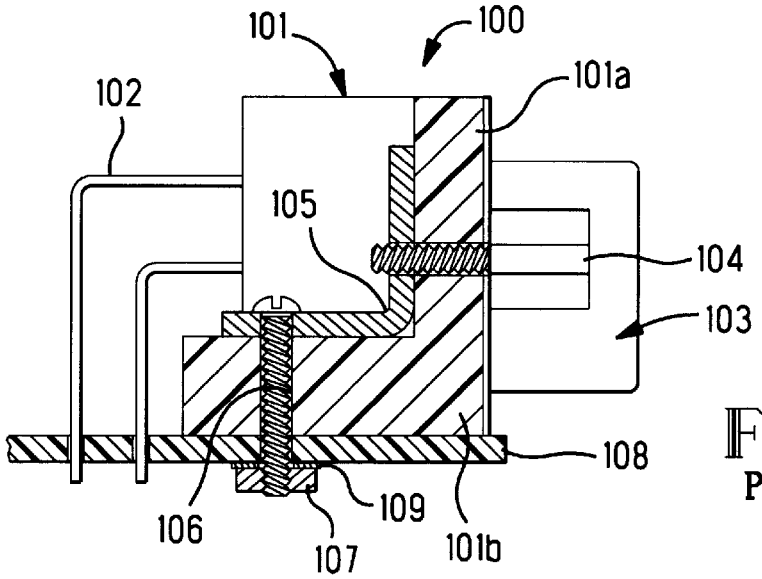
FIG. 4 Prior Art
FIG. 4 is a cross-sectional view of a conventional shielded electrical connector.
Figure 5A:
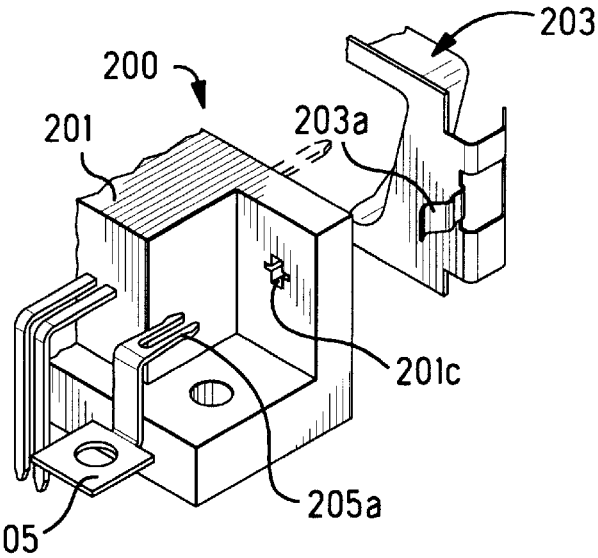
FIG. 5A Prior Art
FIGS. 5A and 5B show another conventional shielded electrical connector.
Figure 5B:
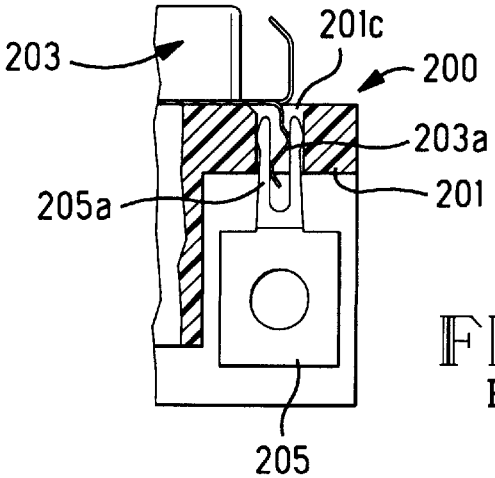
FIG. 5B Prior Art

Shielded electrical connector 1 depicted in FIGS. 1–3 incorporates an insulating housing 10, upper and lower metal shield members 21, 22 comprising a metal shield covering the housing 10 from top and bottom, mounting screws 30 and nuts 33 to secure the shielded electrical connector 1 on circuit board 40.

The housing 10 is molded from a suitable insulating plastic material, and it has at its front end (the upper side of FIG. 1) a rectangular housing member in which multiple electrical contacts 17 are secured, and, at its back end, an entrance to a card-receiving cavity in which a memory card or some other type of PC card 50 is received. The PC card 50 inserted in the housing 10 forms electrical connections with the electrical contacts 17.

On both sides of housing 10, multiple mounting members 11 are provided that are intended to secure the connector 1 to the circuit board 40, and they have mounting bosses 14 (FIG. 3). Each mounting member 11 has an opening at an upper end and a cavity 12 intended to accommodate the mounting nut 33. A through hole 13 extends through the mounting member extending from an upper surface 15 of the mounting member 11 to a bottom surface 16 of the mounting boss 14.

The upper and lower shell members 21, 22 of the shield are fabricated from a metal sheet by stamping and forming, and they cover the housing 10 from the top to the bottom. With respect to the PC card 50 inserted in the card-receiving cavity of the housing 10, the shield members perform the function of an electromagnetic interference (EMI) shield. On both sides of the upper shell member 21, a number of spring-loaded or resilient contact members 23 are located with the purpose of forming a direct spring-loaded electrical connection with threaded portions 31 of the mounting screws 30 that are to be screwed into the mounting nuts 33. All spring-loaded contact members 23 are fabricated on both sides of the upper shell member 21 by bending them downward as cantilever members, and they have at their front ends contact portions 24 that form spring-loaded electrical connection with the side of the threaded portions 31.

Next, an explanation concerning the mounting of the shielded connector 1 to the circuit board 40 and the method of grounding the upper shell member 21 is provided.

During the first step of the process of mounting the shielded electrical connector 1 to the circuit board 40, the mounting nuts 33 are pressed in the cavities 12 of the housing 10. Subsequently, mounting bosses 14 as extensions of mounting members 11 of the housing 10 are inserted in holes 41 provided in the circuit board 40, thereby aligning the through holes 13 with the holes 41 so that the threaded portions 31 of the mounting screws 30 can be inserted from underneath of the circuit board 40 through the through holes 13 and screwed to the mounting nuts 33 by a screwdriver. These operations result in securing the shielded electrical connector 1 to the circuit board 40. At this time, the spring-loaded contact members 23 of the upper shell member 21 form direct spring-loaded electrical connection with the threaded portions 31 of the mounting screws 30. At the same time, the heads 32 of the mounting screws 30 form electrical connection with the ground circuit (not shown) located on a bottom surface of the circuit board 40, thus electrically grounding the upper shell member 21 to the circuit board 40.

In order to effect the grounding of the upper shell member 21 to the circuit board 40 by this method, only screws 30 without any additional parts are used. The ground connection of the upper shell member 21 is highly reliable due to the fact that there are only few joining points. Since the mounting involves the insertion of the threaded portions 31 of the mounting screws 30 into the through holes 13 from underneath of the circuit board 40 while simultaneously screwing them into the nuts 33 by the screwdriver, the grounding of the upper shell member 21 can be performed in one simple operation. Since the upper shell member 21 is grounded by means of the mounting screws 30 and the mounting holes that define the position of the housing 10 on the circuit board 40, these screws have the function of securing the housing 10 and grounding the upper shell member 21 simultaneously. Therefore, there is no need for special tools or devices to provide a grounding connection between the upper shell member 21 and the circuit board 40, thus making it possible to simplify the design of the upper shell member and to reduce its dimensions. The lower shell member 22 may be connected directly to the circuit board 40.

The shielded electrical connector according to the present invention has two shell members covering a housing from the top and the bottom, with the upper shell member having spring-loaded contact members as integral parts of the shell member thereby providing direct spring-loaded electrical connection to threaded portions of mounting screws. Consequently, the ground connection of the upper shell member to the circuit board can be realized by means of the mounting screws without any additional parts; and, since the number of parts is small, the ground connection is distinguished by a dependable reliability. In addition, since the upper shell member is connected to the ground circuit by the mounting screws, there is no need of special tools or devices to secure the upper shell member onto the circuit board, thus making the upper shell member compact and simple in design.

Since in the shielded electrical connector the mounting screws are inserted from underneath the circuit board through the housing and screwed in the mounting nuts, and since the spring-loaded contact members form spring-loaded electrical connection with the threaded portions of the mounting screws, the grounding of the upper shell member is achieved by screwing the mounting screws from underneath of the circuit board into the mounting nuts, thus making the grounding of the shield a simple operation.

What is claimed is:

1. A shielded electrical connector for mounting onto a circuit board, comprising:

an insulating housing having electrical contacts secured therein;

a metal shield including an upper shield covering a top surface of the housing and a lower shield covering a bottom surface of the housing;

mounting members at both sides of the housing having through holes extending therethrough, the through holes being vertically aligned with holes in the circuit board;

mounting screws extending through the holes in the circuit board and through the through holes in the mounting members, the mounting screws being in threaded engagement with mounting nuts for securing the connector on the circuit board; and the upper shield having resilient contact members electrically engaging exposed threaded portions of the mounting screws in a vicinity of the top surface of the housing.

2. The shielded electrical connector as claimed in claim 1, wherein the mounting nuts are disposed in respective cavities in the mounting members.

3. The shielded electrical connector as claimed in claim 1, wherein the mounting screws have heads for electrical connection with a ground circuit on the circuit board.

4. The shielded electrical connector as claimed in claim 1, wherein the mounting members have bosses for engagement with the holes in the circuit board.

* * * * *